United States Patent [19]

Terracol et al.

[11] 4,039,983

[45] Aug. 2, 1977

[54] HIGH-SPEED HIGH-CURRENT CIRCUIT INTERRUPTER HAVING ELECTRODYNAMICALLY OPERATED ARCING CONTACTS

[75] Inventors: Claude Terracol, Eybens; Pierre Schueller, Grenoble, both of France

[73] Assignee: Merlin Gerin, Grenoble, France

[21] Appl. No.: 714,665

[22] Filed: Aug. 16, 1976

[30] Foreign Application Priority Data

| | | |
|---|---|---|
| Aug. 26, 1975 | France | 75.26466 |
| Jan. 26, 1976 | France | 76.02086 |
| Jan. 26, 1976 | France | 76.02085 |

[51] Int. Cl.[2] ..... H01H 77/10

[52] U.S. Cl. ..... 335/16; 335/195

[58] Field of Search ..... 335/16, 147, 195; 200/147

[56] References Cited

U.S. PATENT DOCUMENTS

| | | | |
|---|---|---|---|
| 3,546,641 | 12/1970 | Freeman | 335/16 |
| 3,555,471 | 1/1971 | Mitskevich et al. | 335/16 |
| 3,764,946 | 10/1973 | Mostosi | 335/195 |
| 3,813,619 | 5/1974 | Koval | 335/16 |
| 3,824,508 | 7/1974 | Terracol | 335/16 |

*Primary Examiner*—Harold Broome

*Attorney, Agent, or Firm*—Stevens, Davis, Miller & Mosher

[57] ABSTRACT

High-current, current-limiting circit interrupter having arcing contacts connected in parallel with the main contacts. Impetus means open the main contacts strikingly to switch the short-circuit current to the high-resistance arcing circuit. Electrodynamic means cause the arcing contacts to remain closed a short lapse of time after the transfer of the short-circuit current to the arcing circuit. Further electrodynamic means cause the arcing contacts to open sequentially.

4 Claims, 4 Drawing Figures

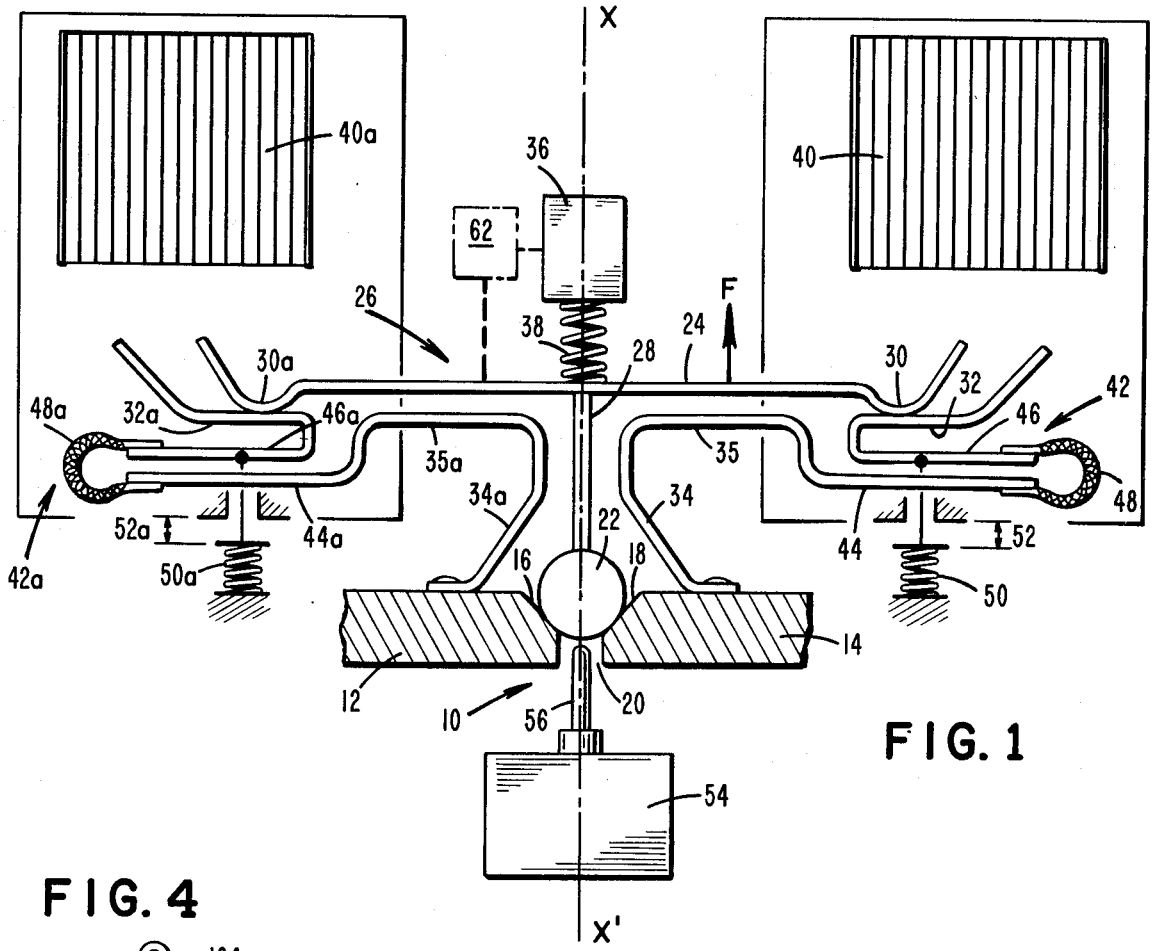
FIG. 1
FIG. 4
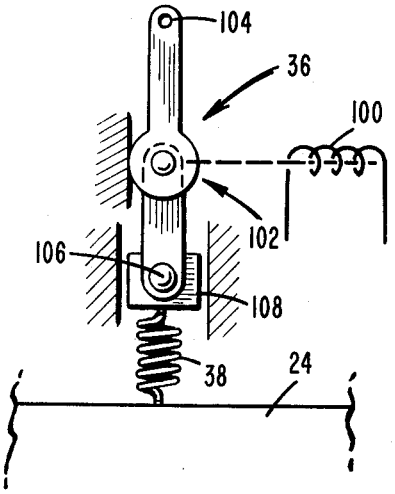
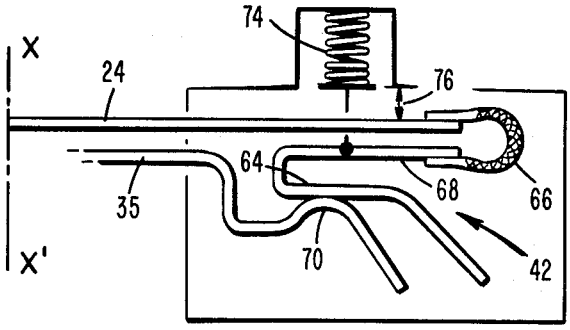
FIG. 2
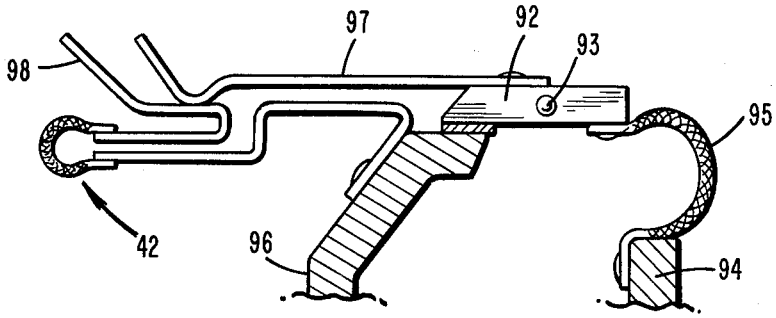
FIG. 3

HIGH-SPEED HIGH-CURRENT CIRCUIT INTERRUPTER HAVING ELECTRODYNAMICALLY OPERATED ARCING CONTACTS

This invention relates to high-current, current-limiting circuit interrupters having arcing contacts and more particularly to circuit interrupters having electrodynamically operated arcing contacts.

Various kinds of electrodynamically operated circuit interrupters are known but the prior-art structures do not permit the utilization thereof in high-current interrupters having a rated current of 1000 A and more, because of the high inertia of the movable main contact.

It is a prime object of the present invention to provide a circuit interrupter having electrodynamically operated contacts permitting the rapid extinction of high currents without causing erratic movements of the contacts.

This and other objects of the invention may be more fully understood upon reading of the following description of some embodiments of the invention schematically shown in the accompanying drawings, in which:

FIG. 1 is an elevational view of a pole of a circuit interrupter according to the invention;

FIG. 2 is a partial view of another embodiment of the invention;

FIG. 3 represents still another embodiment; and

FIG. 4 shows a tripping mechanism.

Referring now to the embodiment represented in FIG. 1, there is shown the contact means of a circuit interrupter (which is not further shown in detail) comprising a main circuit 10 in which are inserted main contact means including a pair of stationary main contacts 12, 14 carrying contact flanges 16, 18, respectively, that are separated by an air gap 20. The air gap 20 may be bridged by contact rod 22 engaging the dihedral contact flanges 16, 18 according to a generatrix when the movable contact rod 22 has a cylindrical shape and according to flat surfaces when the contact rod 22 is coin-shaped. The contact rod 22 extends perpendicularly to the plane of FIG. 1 and has a small mass. The rod 22 is guided for vertical translation as viewed in FIG. 1, along the symmetry-plane X—X' and is mechanically connected by a connection rod 28 to a movable arcing contact 24.

The auxiliary circuit 26 comprises a plurality of longitudinally extending conductors which are symmetrically disposed with respect to the symmetry-plane X—X'. Corresponding parts are designated by the same reference numerals with a lower-case letter affixed to the reference numerals applied to the righthand parts as viewed in FIG. 1. Each end of the movable contact bridge 24 carries an arcing contact 30, 30*a* adapted for engagement with a fixed contact 32, 32*a,* which is electrically connected to the main contact 14, 12 by a conductor 34, 34*a* having a central rectilinear portion 35, 35*a* extending parallelly with and adjacent to the central rectilinear portion of the movable contact bridge 24 of the arcing contacts to constitute a loop-shaped current path. A control mechanism 36 of any appropriate known type urges by means of a spring 38 the movable contact members 22, 24, 28 towards the closed-circuit position of the main and arcing contacts and permits the manual or automatic tripping of the circuit interrupter. An arc-extinction chamber 40, 40a is associated with each pair of arcing contacts 30, 32; 30*a,* 32*a* and comprises in a known manner a plurality of stacked slotted metal plates.

In the closed position of the circuit interrupter the current flows mainly through the main circuit 10 having less resistance than the auxiliary circuit 26. When after the appearance of a fault current, such as a short-circuit current, the main contacts 12, 14 are opened, the current is switched to the auxiliary circuit 26, the loop-shaped portions 35, 35*a,* 24 of which provide electrodynamic repulsion forces tending to move the movable arcing contact rapidly towards the open-circuit position thereof.

A second electrodynamic system 42, 42*a* provides compensation forces avoiding an untimely opening of the arcing contacts 30, 32, 30*a,* 32*a.* Each semi-fixed contact 32, 32*a* is urged towards the closed-circuit position thereof by a spring 50, 50*a* and the stroke 52, 52*a* of the contact is limited by suitable abutment means. It comprises a portion 46, 46*a* extending parallelly to a prolongation 44, 44*a* of the fixed portion 35, 35*a* to which it is connected by a flexible conductor 48, 48*a* in order to constitute a loop-shaped circuit developing electrodynamic forces that tend to maintain the semi-fixed contact 32, 32*a* in engagement with the movable contact 30, 30*a.*

Impetus means comprising an electromagnet 54 having a plunger 56 of insulating material are adapted to strike the movable main contact 22 at the appearance of a short-circuit current. The impact produced by the device 54 is sufficient to cause the main contacts 16, 18, 22 to separate and to switch the current to the auxiliary circuit 26 but insufficient to bring about a further movement of the movable contacts. The impetus device 54 may comprise any system producing a sufficient shock of short duration upon energizing such as a device disclosed in the U.S. Pat. No. 3,824,508 or a Thomson-effect device comprising a movable disc disposed adjacent a coil that is energized by the discharging of a condensor.

This device according to FIG. 1 operates as follows:

At the appearance of a fault current of sufficient magnitude exceeding a predetermined threshold value, the tripping device 54 strikes the movable main contact bar 22 and causes thus the separation of the main contacts 12, 14, 22. A switching arc is drawn and causes the current to be transferred to the auxiliary circuit 26. This current produces electrodynamic repulsion forces between the portions 35, 35*a* and the arcing contact bridge 24 so that the movable parts 22, 28, 24 are further urged in the direction of the arrow F. At the same time the electrodynamic forces acting between the portions 44, 46; 44*a,* 46*a* of the auxiliary circuit cause the loops 42 and 42*a* to expand thereby maintaining the arcing contacts 30, 32; 30*a,* 32*a* for a short time in engagement during the lifting of the contact bridge 24. After take-up of the clearance 52, 52*a* the arcing contacts 30, 32; 30*a,* 32*a* separate at a proper speed favouring the transfer of the arcs drawn between the contacts towards the arc-extinction chambers 40, 40*a* where the arcs are subsequently cooled and extinquished. The threshold value at which the arcing contacts separate is lower than the threshold value at which the main contacts are separated so that the value of the current flowing through the auxiliary circuit immediately upon transfer of the current is higher than the threshold value of this circuit thereby causing a straightforward opening of the arcing contacts without erratic movements thereof. Welding and untimely wear of the contacts is thus avoided.

The electromagnetic and electrodynamic forces acting upong the movable main contact 22 are negligible and the latter has a length as small as possible to reduce the mass thereof.

FIG. 2 represents another embodiment of the compensation system 42. A semi-fixed contact 64 is associated with the movable contact bridge 24 and may engage a fixed contact 70. The semi-fixed contact 64 is urged towards the closed-circuit position thereof by a spring 64 and the stroke of the contact in the opening direction of the associated contact bridge 24 is limited to the value 76. The electrodynamical compensation loop comprises the active portion 68 of the semi-fixed contact 64 and the adjacent parallel portion of the contact bridge 24 to which the portion 68 is connected by a flexible conductor 66. In this embodiment, the semi-fixed contact 64 has not to move with the contact bridge 24 at the beginning of the opening movement so that the compensation forces are dispenses from the driving of the mass of the semi-fixed contact.

FIG. 3 shows another embodiment having a pivotally mounted main contact of small mass which does not involve notable electromagnetic or electrodynamic forces. The movable main contact comprises a short arm 92 pivotally mounted at 93 and electrically connected to a current-supply conductor 94 by a braided flexible conductor 95. The contact 92 may engage a fixed main contact 96 having a bended end portion and carries a movable arcing contact 97 forming part of an elongated loop-shaped arcing circuit. As before, the arcing contact 97 cooperates with a semi-fixed contact 98 provided with a compensation device 42.

The operation if of course similar to that of FIG. 1.

The current-limiting circuit interrupter according to the invention may advantageously be utilized in selective protection networks comprising sequential tripping devices. Some of such systems involve the counting of the opening and closing movements of the circuit interrupters inserted in the network. FIG. 1 shows in phantom lines a counting device 62 associated with the control device 36. The counter may be an electronic counter; a mechanical counter having a step-by-step driven rack mechanism or any appropriate other device. It enables the tripping device 36 only after a predetermined number of opening and closing movements of the contacts.

FIG. 4 represents an embodiment of the control device 36. A collapsible toggle mechanism 102 has one end thereof pivotally mounted on a fixed axis 104, the opposite end being pivotally mounted on a sliding bloc 108 controlling the position of the top of spring 38. In the extended position of the toggle mechanism, the spring 38 urges the movable contacts towards the closed-circuit position, without impeding a rapid opening movement of the contacts in case of a fault current and a subsequent reclosing. An electromagnet 100 causes, when energized, the toggle mechanism to collapse, thereby moving the contacts to the open-circuit position thereof.

What we claim is:

1. A high-current circuit interrupter comprising:

an electrical main circuit;

an electrical auxiliary circuit connected in parallel with said main circuit and having a higher electric resistance than said main circuit;

separable main contact means inserted in said main circuit and having a movable main contact member;

separable arcing contact means inserted in said auxiliary circuit and having a movable arcing contact member in driving connection with said movable main contact member;

elastic means urging said movable contact members resiliently towards the closed-circuit position thereof;

impetus means having a trigger member adapted to mechanically operate said movable main contact member strikingly at the appearance of a short-circuit current flowing through said circuit interrupter to separate said main contact means against the action of said elastic means and transfer said current to said auxiliary circuit;

said auxiliary circuit comprising first electrodynamic means, said first electrodynamic means tending to keep said arcing contact means in the closed-circuit position thereof under the action of said current; and second electrodynamic means urging said arcing contact means towards the open-circuit position thereof under the action of said current;

said first and second electrodynamic means being adapted to cause said arcing contacts to remain in the closed-circuit position thereof a short lapse of time after the transfer of said current to said auxiliary circuit and to sequentially separate, thereby to draw an arc therebetween.

2. A circuit interrupter according to claim 1, said first and second electrodynamic means being adapted to maintain said arcing contact means in the closed-circuit position thereof during the beginning of the opening movement of said movable arcing contact member.

3. A circuit interrupter according to claim 1, said second electrodynamic means comprising a portion of said movable arcing contact member extending linearly a length substantially parallelly to an adjacent portion of a fixed conductor, said portions extending substantially perpendicularly to the direction of movement of said movable contact members, said current flowing through said portions in opposite directions.

4. A circuit interrupter according to claim 1, said first electrodynamic means comprising a variable-shape current loop inserted in said auxiliary circuit, said circuit interrupter further comprising abutment means to limit the expansion of said loop under the action of said current.

* * * * *